US008381689B2

(12) United States Patent
Huang et al.

(10) Patent No.: US 8,381,689 B2
(45) Date of Patent: Feb. 26, 2013

(54) METHOD FOR EXAMINING WATER HEATER SAFETY

(75) Inventors: Chung-Chin Huang, Taichung (TW); Chin-Ying Huang, Taichung (TW); Hsin-Ming Huang, Taichung (TW); Hsing-Hsiung Huang, Taichung (TW); Kuan-Chou Lin, Taichung (TW)

(73) Assignee: Grand Mate Co., Ltd, Taichung (TW)

( * ) Notice: Subject to any disclaimer, the term of this patent is extended or adjusted under 35 U.S.C. 154(b) by 272 days.

(21) Appl. No.: 12/954,382

(22) Filed: Nov. 24, 2010

(65) Prior Publication Data

US 2012/0126987 A1 May 24, 2012

(51) Int. Cl.
*F24H 9/20* (2006.01)

(52) U.S. Cl. ..... 122/14.22; 340/584; 340/632; 122/13.01; 122/14.2

(58) Field of Classification Search ..... 340/584, 340/501, 517, 521, 588; 122/13.01–14.22; 165/292, 293
See application file for complete search history.

(56) References Cited

U.S. PATENT DOCUMENTS 1,845,581 A * 2/1932 Coakley ..... 122/14.22
4,867,375 A * 9/1989 Ueki et al. ..... 236/12.12
4,922,861 A * 5/1990 Tsutsui et al. ..... 122/448.1
5,630,408 A * 5/1997 Versluis ..... 122/14.21
6,536,680 B2 * 3/2003 Takagi et al. ..... 237/12.3 C
7,647,895 B2 * 1/2010 Donelly et al. ..... 122/14.21
7,720,635 B2 * 5/2010 Donath et al. ..... 702/182
7,810,456 B2 * 10/2010 Kobayashi ..... 122/31.1
2009/0159017 A1 * 6/2009 Tsuge ..... 122/14.1
2010/0116222 A1 * 5/2010 Tsuji et al. ..... 122/14.2
2011/0146945 A1 * 6/2011 Morita et al. ..... 165/51
2012/0006527 A1 * 1/2012 Huang et al. ..... 165/295
2012/0052453 A1 * 3/2012 Besore et al. ..... 431/14

* cited by examiner

*Primary Examiner* — Daniel Wu
*Assistant Examiner* — Son M Tang
(74) *Attorney, Agent, or Firm* — Tracy M. Heims; Apex Juris, pllc

(57) ABSTRACT

A method for examining water heater safety includes the steps of: setting a desired temperature and sensing a cold water temperature and a flow rate of water to calculate a theoretical gas consumption, and then supplying a combustor the theoretical gas consumption to heat water; sensing a hot water temperature, and calculating a temperature ratio by the desired temperature, the cold water temperature and the hot water temperature. Examining the temperature ratio may find that the water heater is abnormal or malfunctioning. An efficiency ratio may also be calculated by the theoretical gas consumption and the actual gas consumption. Examining the efficiency ratio may find that the water heater is abnormal or malfunctioning as well.

12 Claims, 4 Drawing Sheets

METHOD FOR EXAMINING WATER HEATER SAFETY

BACKGROUND OF THE INVENTION

1. Field of the Invention

The present invention relates generally to a water heater, and more particularly to a method for examining water heater safety.

2. Description of the Related Art

Water heater usually has problems such as aging or malfunction because of time or environment. An aged or malfunctioning water heater has poor efficiency in heating that it needs more gas to heat water to a desired temperature. It wastes energy and increases expense for the user.

In addition, the aged or malfunctioning water heater may still encounter other problems such as incomplete combustion and gas leakage. These water heaters may cause dangers to human life.

SUMMARY OF THE INVENTION

The primary objective of the present invention is to provide a method of examining the heating efficiency of a water heater and whether or not the water heater is aged or malfunctioning.

According to the objective of the present invention, a method for examining water heater safety is presented, wherein the water heater includes a water pipe, a combustor to heat the water pipe, a gas supply to supply the combustor gas, and an examining unit to sense water temperatures. The method includes the steps of: setting a desired temperature; sensing a cold water temperature at an inlet of the water pipe and a flow rate of water; calculating a theoretical gas consumption for the combustor to heat water in the water pipe from the cold temperature to the desired temperature in a predetermined time and the flow rate; heating water in the water pipe; sensing a hot water temperature at an outlet of the water pipe when the theoretical gas consumption has run out; calculating a temperature ratio by dividing a temperature difference of the hot water temperature and the cold water temperature by a temperature difference of the desired temperature and the cold water temperature; and examining the temperature ratio to generate a signal when the temperature ratio is less than a certain value. The signal may give a command to generate an alarm or cut off gas, or both.

In an embodiment, the combustor keeps heating water after the theoretical gas consumption has run out until the hot water temperature reaches the desired temperature. An efficiency ratio is calculated by dividing a heat generated from the theoretical gas consumption by a heat generated from the actual gas consumption, and then the efficiency ratio is examined to generate a signal when the efficiency ratio is less than the value.

DETAILED DESCRIPTION OF THE INVENTION

Figure 1:
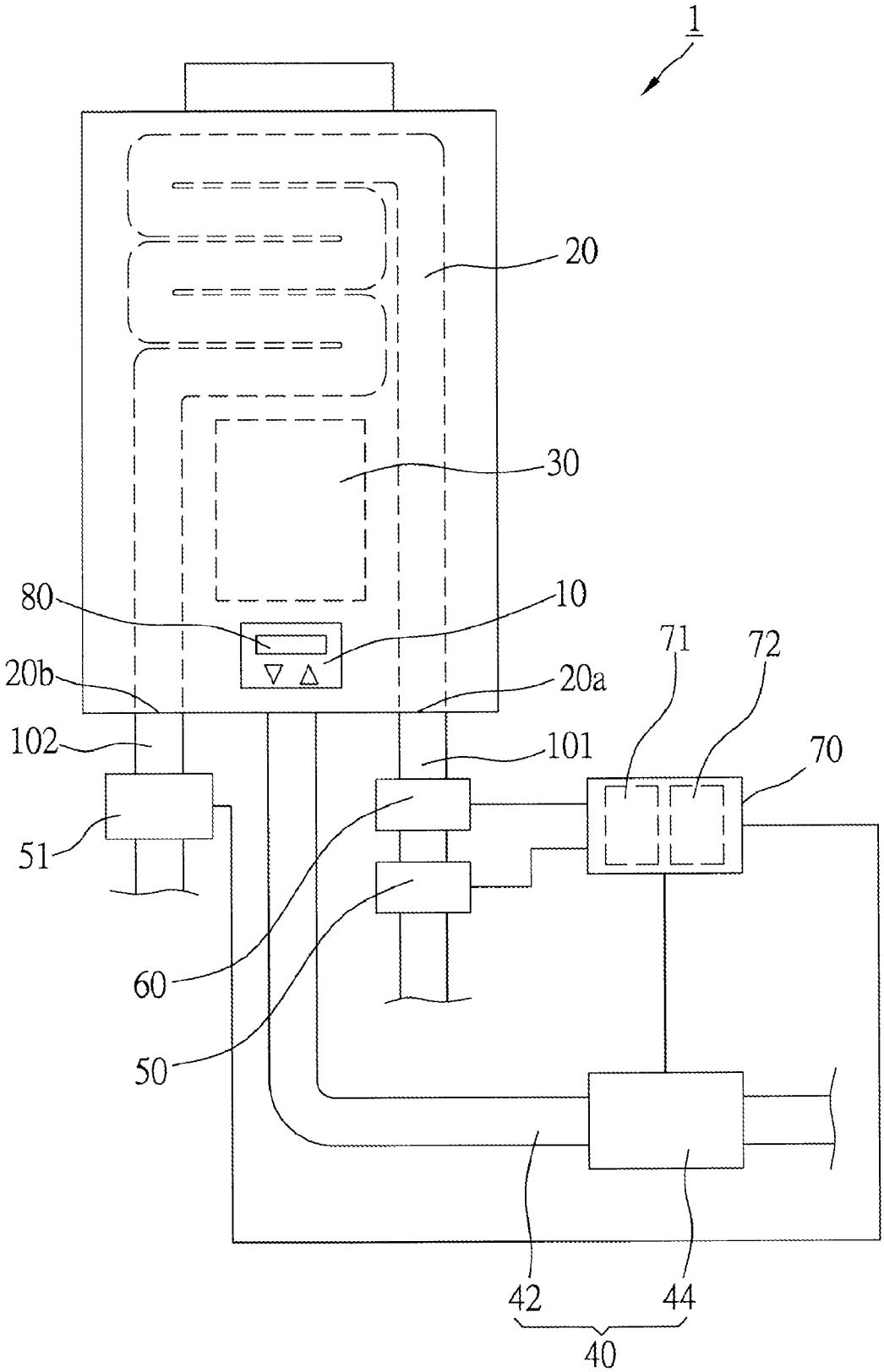
FIG. 1 is a sketch diagram of the water heater.

FIG. 1 shows the structure of a water heater 1 including a temperature setting unit 10, a water pipe 20, a combustor 30, a gas supply 40, two temperature sensors 50, 51, a flow rate sensor 60, a controller 70, and an alarm device 80. The water pipe 20 has an inlet 20*a* and an outlet 20*b*. The gas supply 40 includes a gas pipe 42 and a valve 44 on the gas pipe 42 to adjust a flow rate of gas in the gas pipe 42. The gas valve 44 may be controlled by current, like U.S. Publication No. 20090206291A1 "gas flow rate control valve", or other valves with the same function, such as swivel valve, to adjust the gas flow under control. The controller 70 has a calculating unit 71 and an examining unit 72.

Figure 2:
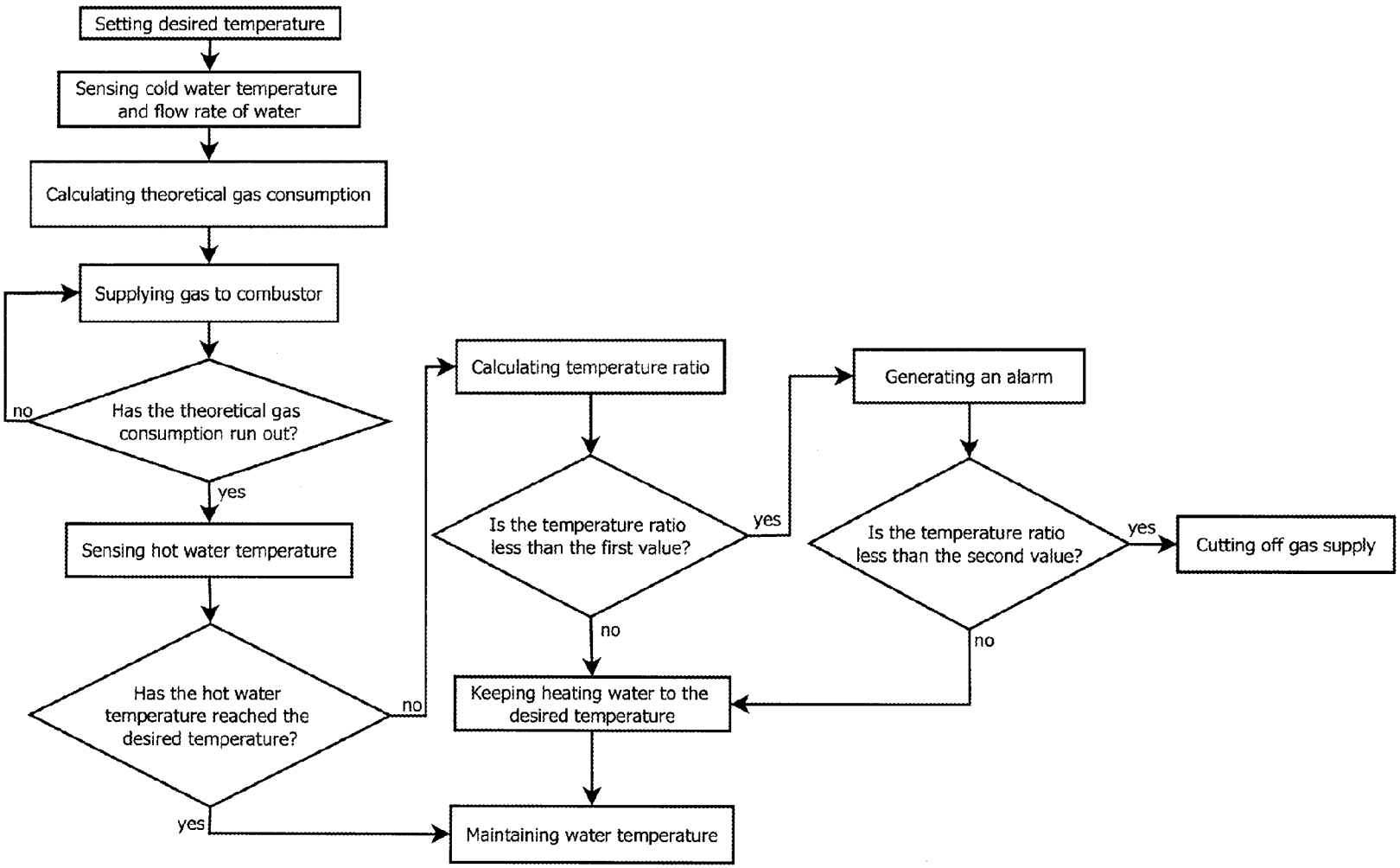
FIG. 2 is a flow chart of a first preferred embodiment of the present invention.

FIG. 2 shows the flow chart of the examining method of the first preferred embodiment including the steps of:

Setting a desired temperature via the temperature setting unit 10. The desired temperature is a standard temperature for temperature control.

One of the temperature sensors 50 and the flow rate sensor 60 are provided at a pipe 101, which is connected to the inlet 20*a* of the water pipe 20 to sense a cold water temperature and a flow rate at the inlet 20*a* of the water pipe 20 when the water heater 1 is turned on. The signals of the cold water temperature and the flow rate are sent to the controller 70 that the calculating unit 71 may calculate a total heat for heating water from the water temperature to the desired temperature in a predetermined period of time. Based on the total heat, it may calculate a theoretical gas consumption. An equation to calculate the total heat is:

$$H_{total}=C_w*(T_d-T_{cw})*Q*t$$

wherein:

$H_{total}$: total heat $C_w$: heat capacity $T_d$: desired temperature $T_{cw}$: cold water temperature Q: flow rate t: time After calculation of the total heat, the controller 70 gives a command to gas valve 44 to adjust the flow rate of gas to supply the combustor 30 with the gas of the theoretical gas consumption in the predetermined period of time to heat water in the water pipe 20.

The other temperature sensor 51 is provided at a pipe 102, which is connected to the outlet 20*b* of the water pipe 20 to sense a hot water temperature at the outlet 20*b*. The controller 70 gives a command to the water valve to supply the combustor 30 with gas of a lower flow rate to maintain the water temperature when the gas of the theoretical gas consumption has been supplied to the combustor 30 and the hot water temperature reaches the desired temperature. When the temperature sensor 51 senses that the hot water temperature is under the desired temperature, the calculating unit 71 calculates a ratio of temperature differences, which comes from a temperature difference of the hot temperature and the cold water temperature divided by a temperature difference of the desired temperature and the cold water temperature.

Which is:

$$R_t(T_{hw}-T_{cw})/(T_d-T_{cw})$$

wherein:

$R_t$: temperature ratio $T_{hw}$: hot water temperature $T_{cw}$: cold water temperature $T_d$: desired temperature The temperature ratio is compared with a first value stored in the examining unit 72. When the temperature ratio is less than the first value, the examining unit 72 transmits a first signal to the alarm device 80 to generate an alarm for an abnormal condition of the water heater 1. In the present embodiment, the first value is 0.9. It indicates that the water heater 1 is slightly aged or abnormal when the temperature ratio is less than the first value. Next, the temperature ratio is compared with a second value. When the temperature ratio is less than the second value, the examining unit 72 transmits a second signal and controls the gas valve 44 to cut off the gas supply. In the present embodiment, the second value is 0.7. It indicates that the water heater 1 has serious aging or malfunction problem when the temperature ratio is less than the second value and the water heater automatically cuts off gas supply for safety. When the temperature ratio is between the first value and the second value, the combustor 30 will keep heating water until it reaches the desired temperature.

It is noted that the first value and the second value are various according to the model of the water heater, environment and other specific requirements. They are predetermined in the manufactory.

Figure 3:
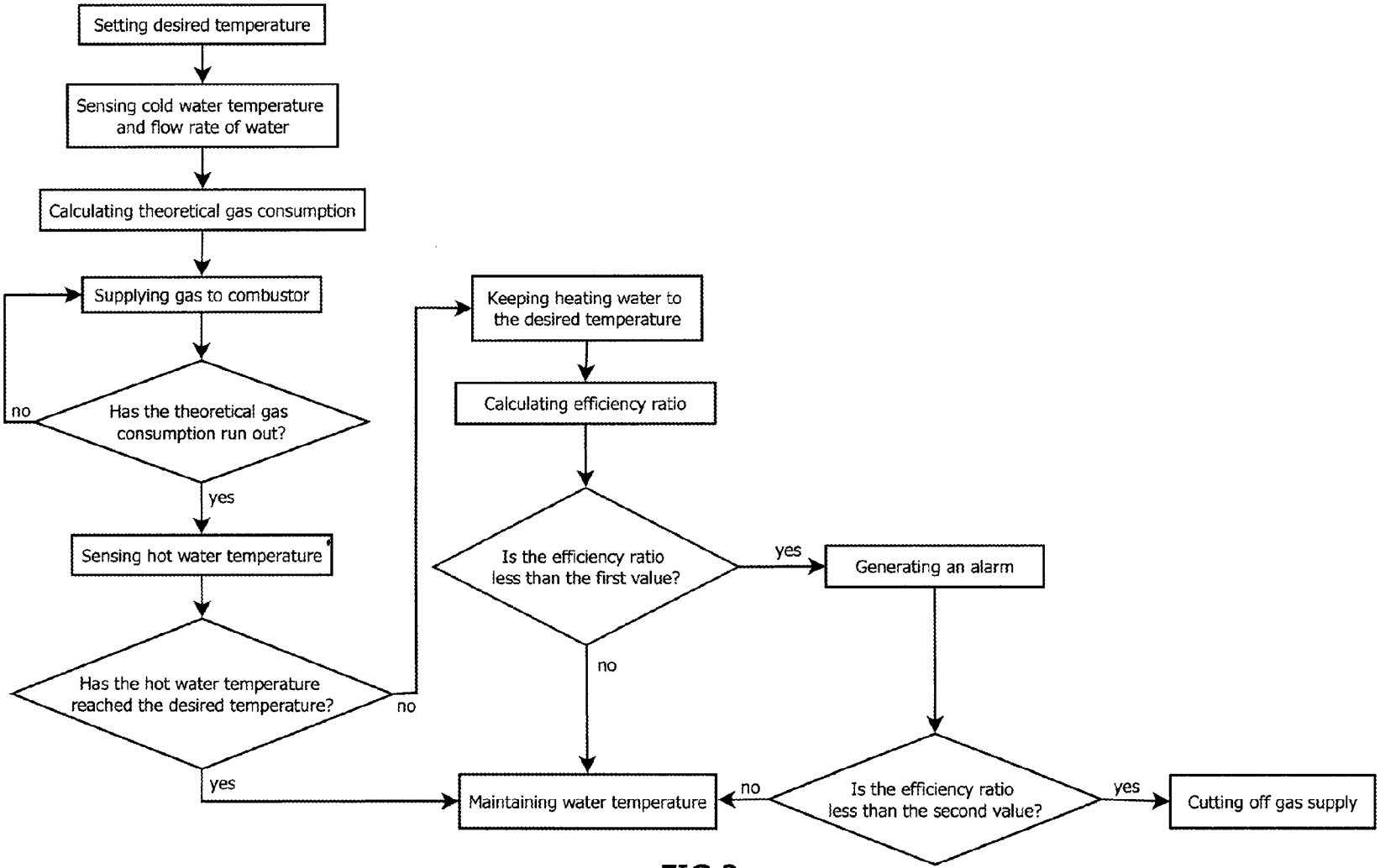
FIG. 3 is a flow chart of a second preferred embodiment of the present invention.

FIG. 3 shows a method of safety examination of the second preferred embodiment of the present invention, which is similar to the method of the first preferred embodiment, except that:

In the second preferred embodiment, when the hot water temperature doesn't reach the desired temperature after running out of the theoretical gas consumption, the gas supply 40 supplies the combustor 30 compensatory gas until the hot water temperature reaches the desired temperature. An efficiency ratio of is calculated by the calculating unit 71 according to the compensatory gas and the theoretical gas consumption.

$$R_{eff}=H_t/H_a$$

$R_{eff}$: efficiency ratio $H_t$: heat generated from the theoretical gas consumption $H_a$: actual heat for heating water The efficiency ratio of is compared with a first value and a second value. When the efficiency ratio is less than the first value, the examining unit 72 transmits a signal to the alarm device 80 to generate an alarm. When the efficiency ratio is less than the second value, the examining unit 72 transmits a signal to the gas valve 44 to cut off the gas supply. When the efficiency ratio is between the first value and the second value, the gas supply supplies a constant gas supply to maintain the water temperature. It is noted that the first value is 0.9 to indicate that the water heater 1 is slightly aged or abnormal, and the second value is 0.7 to indicate that the water heater 1 has serious aging or malfunction problem.

Figure 4:
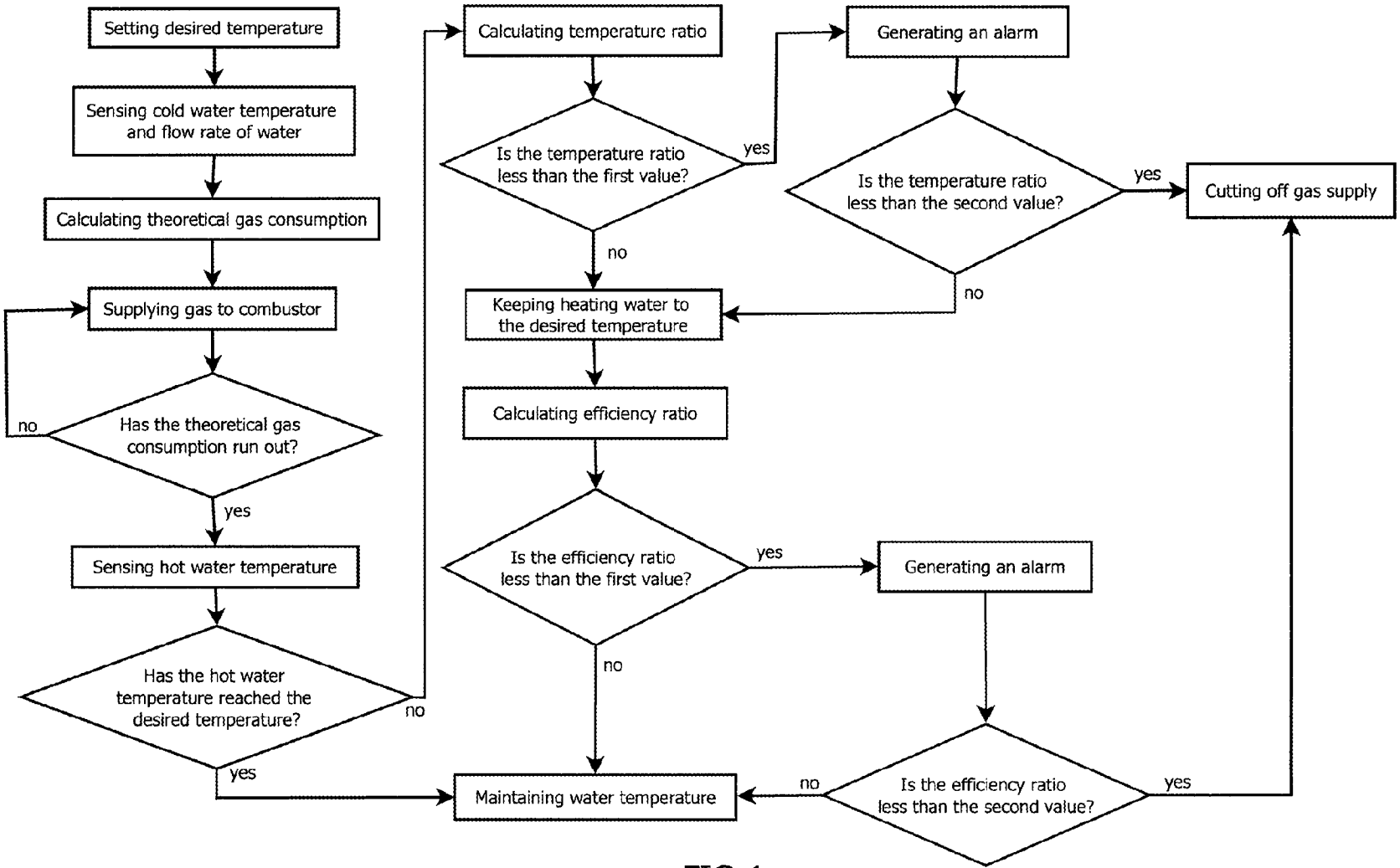
FIG. 4 is a flow chart of a third preferred embodiment of the present invention.

FIG. 4 shows a method of the third preferred embodiment of the present invention, which combines the steps of the first preferred embodiment and the second preferred embodiment to examine for safety. Both of the temperature ratio and the efficiency ratio are calculated to examine the water heater 1. In other words, the safety of the water heater 1 is checked twice to generate an alarm for abnormal condition or cut off gas supply for serious problems when any of the ratios is under the values as described above.

The description above is a few preferred embodiments of the present invention and the equivalence of the present invention is still in the scope of claim construction of the present invention.

What is claimed is:

1. A method for examining water heater safety, wherein the water heater includes a water pipe, a combustor to heat the water pipe, a gas supply to supply the combustor gas, and an examining unit to sense water temperatures, comprising the steps of:

setting a desired temperature;

sensing a cold water temperature at an inlet of the water pipe and a flow rate of water;

calculating a theoretical gas consumption for the combustor to heat water in the water pipe from the cold water temperature to the desired temperature in a predetermined time and the flow rate under an ideal condition;

sensing a hot water temperature at an outlet of the water pipe;

heating water in the water pipe until the theoretical gas consumption has run out;

calculating a temperature ratio by dividing a temperature difference of the hot water temperature and the cold water temperature by a temperature difference of the desired temperature and the cold water temperature; and examining the temperature ratio to generate a signal when the temperature ratio is less than a value.

2. The method as defined in claim 1, wherein the value is 0.9, and the signal is transmitted to an alarm device to generate an alarm when the temperature ratio is less than 0.9.

3. The method as defined in claim 1, wherein the value is 0.7, and the signal is transmitted to the gas supply to cut off gas when the temperature ratio is less than 0.7.

4. The method as defined in claim 1, further comprising the steps of keeping heating water after the theoretical gas consumption has run out until the hot water temperature reaches the desired temperature, and calculating an efficiency ratio by dividing a heat generated from the theoretical gas consumption by a heat generated from an actual gas consumption, and examining the efficiency ratio to generate a signal when the efficiency ratio is less than the value.

5. The method as defined in claim 4, wherein the value is 0.9, and the signal is transmitted to an alarm device to generate an alarm when the efficiency ratio is less than 0.9.

6. The method as defined in claim 4, wherein the value is 0.7, and the signal is transmitted to the gas supply to cut off gas when the efficiency ratio is less than 0.7.

7. A method for examining water heater safety, wherein the water heater includes a water pipe, a combustor to heat the water pipe, a gas supply to supply the combustor gas, and an examining unit to sense water temperatures, comprising the steps of:

setting a desired temperature;

sensing a cold water temperature at an inlet of the water pipe and a flow rate of water;

calculating a theoretical gas consumption for the combustor to heat water in the water pipe from the cold water temperature to the desired temperature in a predetermined time and the flow rate under an idea condition;

sensing a hot water temperature at an outlet of the water pipe;

heating water in the water pipe until the hot water temperature reaches the desired temperature;

getting an actual gas consumption for heating water;

calculating an efficiency ratio by dividing a heat generated from the theoretical gas consumption by a heat generated from the actual gas consumption; and examining the efficiency ratio to generate a signal when the efficiency ratio is less than the value.

8. The method as defined in claim 7, wherein the value is 0.9, and the signal is transmitted to an alarm device to generate an alarm when the efficiency ratio is less than 0.9.

9. The method as defined in claim 7, wherein the value is 0.7, and the signal is transmitted to the gas supply to cut off gas when the efficiency ratio is less than 0.7.

10. The method as defined in claim 7, further comprising the steps of calculating a temperature ratio by dividing a temperature difference of the hot water temperature and the cold water temperature by a temperature difference of the desired temperature and the cold water temperature, and examining the temperature ratio to generate a signal when the temperature ratio is less than a value.

11. The method as defined in claim 10, wherein the value is 0.9, and the signal is transmitted to an alarm device to generate an alarm when the temperature ratio is less than 0.9.

12. The method as defined in claim 10, wherein the value is 0.7, and the signal is transmitted to the gas supply to cut off gas when the temperature ratio is less than 0.7.

* * * * *